US005975415A

United States Patent [19]

Zehnal

[11] Patent Number: 5,975,415

[45] Date of Patent: Nov. 2, 1999

[54] RECLOSABLE CARTON

[75] Inventor: Sally A. Zehnal, San Diego, Calif.

[73] Assignee: Hewlett-Packard Co., Palo Alto, Calif.

[21] Appl. No.: 09/057,822

[22] Filed: Apr. 9, 1998

[51] Int. Cl.[6] ..... B65D 17/00

[52] U.S. Cl. ..... 229/223; 229/158; 229/117.18; 229/160.2; 206/806; 206/815

[58] Field of Search ..... 229/155, 157, 229/223, 227, 160.2, 117.18, 149, 158, 221, 222; 206/804, 815, 806

[56] References Cited

U.S. PATENT DOCUMENTS

| | | | |
|---|---|---|---|
| 2,060,240 | 11/1936 | Pergande | 229/155 X |
| 2,789,751 | 4/1957 | Feldman | 229/149 X |
| 3,125,279 | 3/1964 | Watts et al. | 229/149 X |
| 3,263,899 | 8/1966 | Collura et al. | 229/222 |
| 3,507,442 | 4/1970 | Van Dam et al. | 229/117.18 |
| 3,587,837 | 6/1971 | Smith | 206/455 |
| 3,695,508 | 10/1972 | Hocking | 206/806 X |
| 4,062,486 | 12/1977 | Goodrich | 229/223 |
| 4,111,297 | 9/1978 | Paulin | 206/806 X |
| 4,331,240 | 5/1982 | Vanasse | 206/806 X |
| 4,457,431 | 7/1984 | Lundquist et al. | 229/101.1 |
| 4,484,683 | 11/1984 | Werner et al. . | |
| 4,508,226 | 4/1985 | Davis et al. . | |
| 4,552,268 | 11/1985 | Lee | 206/455 |
| 4,723,658 | 2/1988 | Steel . | |
| 4,809,853 | 3/1989 | Weber . | |
| 4,989,735 | 2/1991 | O'Brien . | |
| 5,014,855 | 5/1991 | Roccaforte . | |
| 5,123,589 | 6/1992 | Cote | 229/232 |
| 5,570,782 | 11/1996 | Kikuchi et al. | 229/149 X |

*Primary Examiner*—Gary E. Elkins
*Assistant Examiner*—Tri M. Mai

[57] ABSTRACT

A reclosable carton having an integrated hang tab adapted for use on standard store pegboard or racking displays wherein the integrity of the hangtab is such that it will withstand the loading of weights comparable to or exceeding those withstood by pressure sensitive hangtabs. The hangtab is perforated along the bottom so that it can be torn off by the consumer after purchase. With the hangtab in use, the carton with which it is integrated provides continuous closure to the product inside via a top inside major flap which prevents dust and debris from entering the carton. A zipstrip is included and it provides a positive closure for the package which is tamper evident and secure. A reclose tab is integrated into the zipstrip. When the zipstrip is removed, the reclose tab is created. It can be tucked into a corresponding opening in the carton front wall panel for carton reclosure. Additionally, a secure locking ellipse is incorporated into the carton. During carton reclosing, the ellipse is inserted first into a corresponding opening in the carton front wall panel, followed by insertion of the reclose tab into its corresponding opening.

17 Claims, 3 Drawing Sheets

RECLOSABLE CARTON

FIELD OF THE INVENTION

The present invention relates generally to containers and, more particularly, to reclosable cartons having product access characteristics, and the carton blank from which such cartons are formed.

BACKGROUND OF THE INVENTION

Reclosable cartons of the type used as containers for a wide variety of goods are conventionally formed from carton blanks made from sheet material such as paperboard. While the contents of the cartons may differ, a capability of providing structural integrity and exposure protection of the contents are generally worthwhile characteristics. Of course, it is important to attempt to realize these features while avoiding excessive material cost or over design of the carton. Thus, it is desirable to have a sturdy carton which provides a protective environment for its contents and is, nevertheless, economical to produce.

The protection of carton contents is a consideration which arises at several points in a product distribution scheme. It is important, for example that the carton make the trip from the manufacturing source to the retail establishment without damage. At the retail level, factors such as how favorably to display the carton without damaging its contents, come into play. In the case of some conventional cartons, a pressure sensitive hangtab is added to the finished product so that the carton may be displayed on a standard store pegboard or racking display. This approach adds to the price of the goods by increasing both labor and material costs. In an attempt to mitigate these factors, some cartons are equipped with an integrated hangtab which can be lifted from the top of the carton to engage the pegboard. While the integrated hangtab may be preferable to the stick-on type, its use ruptures the integrity of the container, leaving an opening in the carton for entry of unwanted substances. Thus, such conventional techniques can present a risk of damage to the contents of the carton and permit unobserved tampering with the contents.

The issue of product integrity is seen even after the carton has been purchased. This is especially the case where the carton contents are not used at one time. Instead, in cases where the carton is used to retain and dispense individual flat goods such as paper, cards or film, the carton may be opened and subsequently used for a substantial period of time, until the contents are depleted.

In view of the foregoing, it would be highly desirable to have a reclosable carton which would protect contents prior to sale from contamination from environmental sources. Preferably, such a carton would also provide evidence of tampering. Ideally, after purchase and over an extended period of time, such a carton would provide protection of its contents from unwanted environmental substances.

SUMMARY OF THE INVENTION

The reclosable carton of the present invention provides an integrated hang tab that eliminates the need to apply a plastic pressure sensitive hangtab to the finished package. In this manner, labor costs for applying the hangtab to the finished package are eliminated. Carton design cost is not increased by the addition of the integrated hangtab which can be used at point of purchase or not be used at the discretion of the retailer. The design of the hangtab is such that it will fit on standard store pegboard or racking displays, and the integrity of the hangtab is such that it will withstand the loading of weights comparable to or exceeding those withstood by pressure sensitive hangtabs. The hangtab is perforated along the bottom so that it can be torn off by the consumer after purchase.

The carton of the present invention provides substantial content protection. Thus, even if the hangtab is used, the carton with which it is integrated provides continuous closure to the product inside by means of a top inside major flap. Thus, dust and debris are prevented from entering the package and the product is still tamper protected. This protection, afforded by the cooperation between the hangtab and the inside major flap, enable use of an integrated hangtab even in cases that previously presented problems because of the existence of product exposure. In addition, the utility of the hangtab has been increased since its geometry has been optimized to provide maximum tear resistance performance while supporting the package.

An easy open zipstrip is incorporated in the design of the carton. It provides a positive closure for the package which is tamper evident and secure. This eliminates the need for shrink-wrap or a label to close the package. It also replaces a less secure method of closure of previous packages by dots of glue in a few areas that release easily with opening pressure. A reclose tab is integrated into the zipstrip. When the zipstrip is removed, the reclose tab is created. It can be tucked into a corresponding opening in the carton front wall panel for positive carton reclosure. Additionally, a locking ellipse is incorporated into the carton design. For carton reclosure, the ellipse and the reclose tab are inserted into corresponding openings in the carton front wall panel where they are releasably held as a result of the novel geometry and placement of elements in the present invention. In this manner, positive carton reclosure is achieved.

BRIEF DESCRIPTION OF DRAWINGS

The above mentioned features of this invention and the manner of attaining them will become apparent and the invention itself will be best understood by reference to the following description of the embodiment of the invention in conjunction with the accompanying drawings, wherein.

BEST MODE FOR CARRYING OUT THE INVENTION

The present invention may be embodied in other specific forms without departing from its spirit or essential characteristics. Thus, the described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Figure 1:
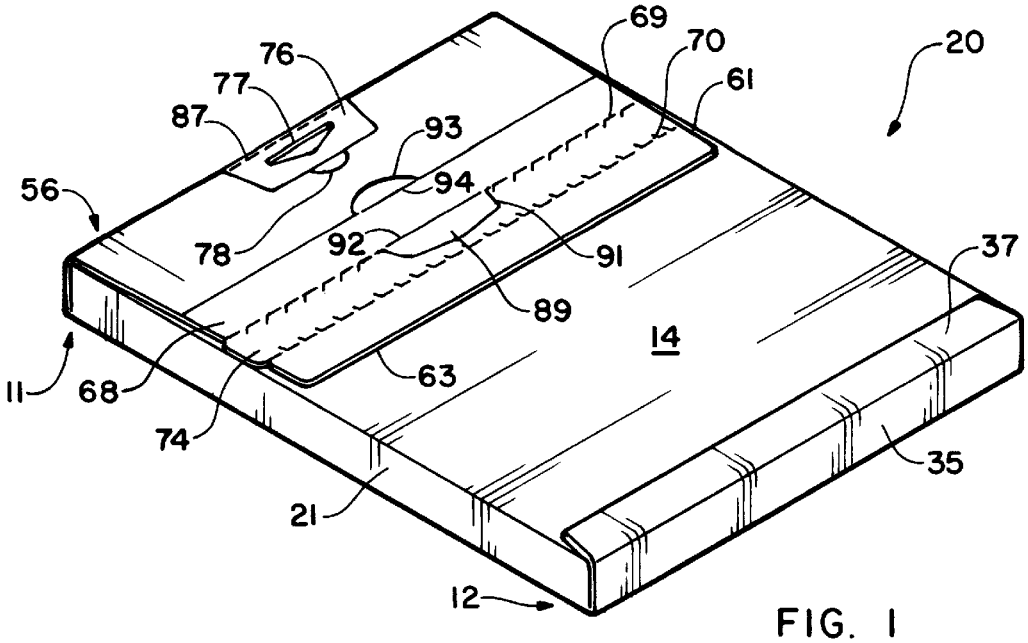
FIG. 1 is a perspective view of a reclosable carton constructed according to the present invention.
Figure 2:
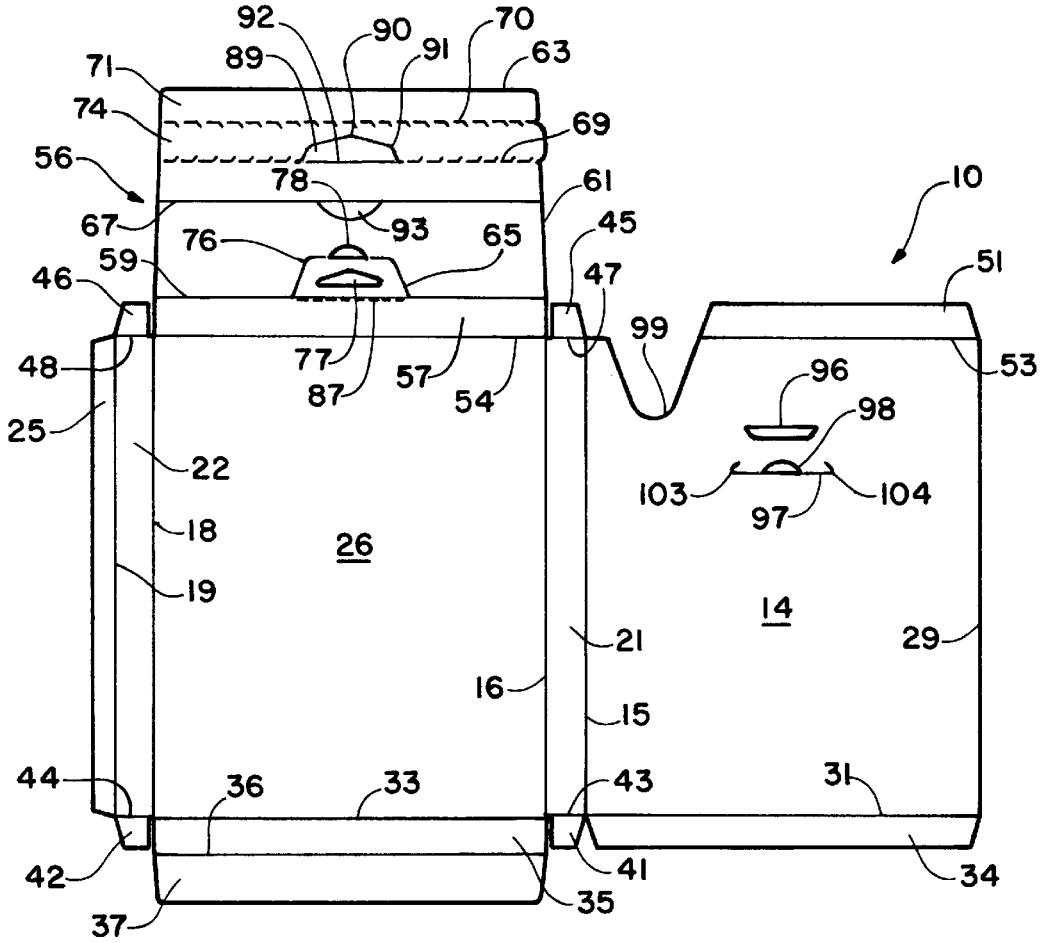
FIG. 2 is a plan view of a blank from which the carton of FIG. 1 is formed.
Figure 3:
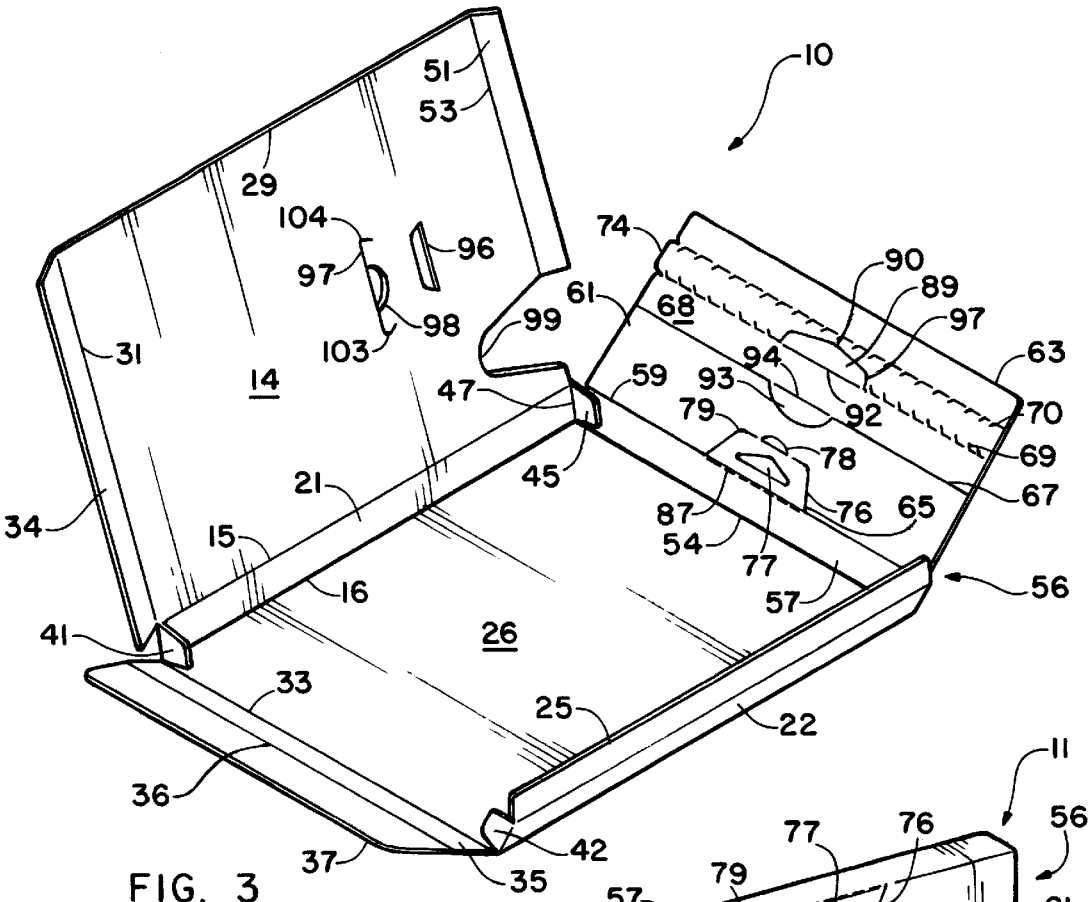
FIG. 3 is a perspective view showing the reverse side of the blank of FIG. 2.

Referring now to the drawings, there is shown in FIGS. 2 and 3 a blank 10 and, in FIGS. 1 and 4–8, there is shown a carton 20 which is constructed from the blank 10, according to the present invention. The carton 20 is box-like in configuration, having squared edges on top, bottom and sides for protection and ease of dispensing of flat sheets. The carton is closed at its opposite ends and having an upper end 11 and a lower end 12.

Referring to FIGS. 2 and 3, there is shown an unitary blank, generally identified as 10, from which the carton 20 is formed. The blank 10 is formed of suitable paperboard and is generally rectangular in outline. The blank 10 includes a major panel 14, which for the sake of convenience, will be referred to as the front panel of the carton 20, the panel 14 being connected at a score or fold line 15 to a left side panel 21. The left side panel 21 in turn is connected along a score line 16 to a major panel 26, referred to herein as the back panel 26, which in turn is connected along a score line 18 to a right side panel 22, in turn connected along a score line 19 to a glue flap 25.

It should be noted that the relative terms "front", "back", "left side" and "right side" are used herein for convenience of description and do not necessarily relate to the way a customer might view the carton 20 as it hangs from a pegboard in a retail store.

In the portion of the blank 10 that forms the lower end 12 of the carton 20, the back panel 26 is connected at a score line 33 to a bottom outside major flap 35 which is in turn connected at a score line 36 to a bottom glue flap 37. A bottom inside major flap 34 is connected at a score line 31 to the front panel 14. Minor bottom flaps 41 and 42 are connected, respectively, at score lines 43 and 44, to the front panel 14 and the back panel 26, respectively.

During assembly of the carton 20, the minor bottom flaps 41 and 42 are folded inwardly at their respective score lines 43 and 44, the front panel 14 is folded at the score line 15, and the left side panel 21 is folded at the score line 16, so that the front panel 14 lies parallel with the back panel 26. The glue flap 25 is firmly adhered to the inside of the front panel 14, along an outer edge 29 thereof, by means of melted glue. The bottom inside major flap 34 is then folded at the score line 31 to overlap the bottom minor flaps 41 and 42. The bottom outside major flap 35 is then folded along the score line 33 to cover the outside surface of the front panel 14 and the bottom glue flap 37 is glued to the outside surface of the front panel 14 by means of melted glue.

As shown most clearly in FIGS. 2 and 3, at the top end 11 of the carton 20 there are formed a pair of top inside minor flaps 45 and 46 which are foldably connected at score lines 47 and 48, respectively, to the left side panel 21 and to the right side panel 22, respectively. In like manner, a top inside major flap 51 and a top outside major flap, represented generally by the reference numeral 56, are foldably connected at score lines 53 and 54, respectively, to the front panel 14 and to the back panel 26, respectively.

The top outside major flap 56 is comprised of a plurality of flat, parallel segments, connected seriatim, one to another, between the score line 54 and a top outside major flap leading edge 63. These are: a segment 57 which is foldably connected at the score line 54 to the back panel 26; a segment 61, foldably connected to the segment 57 at a score line 59; a segment 68, foldably connected at a score line 67 to the segment 61; a tear strip, or zipstrip 74, connected along a zipstrip cut pattern 69 to the segment 68, and along a zipstrip cut pattern 70, to a segment 71 which ends at the leading edge 63. In construction of the carton 20, the segment 71 is glued to the front panel 14.

Considering now the segment 61, with regard to FIGS. 1–7, there is shown a hangtab 76 which is formed within the segment 61. In this regard, the hangtab 76 is die cut from the sheet material forming the segment 61, along a cut line 79. The hangtab 76 is held in place against the segment 61, in a conventional manner, at discrete attachment points (not shown) which can be torn easily when the hangtab 76 is to be used. As shown in FIGS. 1–3, the hangtab 76 is attached to the segment 57 along a line of weakening or perforated line 87 in the score line 59. Thus, after purchase of the carton 20, or at any other expedient time, the hangtab 76 can be conveniently removed from the carton 20 by tearing it along the perforated line 87.

Now considering the hangtab 76 in greater detail, the hangtab is generally trapezoidal in shape having a broad base 65 along the perforated line 87. The broad base 65 provides tear resistance and substantial support to carton 20 contents when the hangtab 76 is utilized to hang the carton 20. An opening 77 in the hangtab 76 provides for easy engagement of a store pegboard (not shown).

Figure 4:
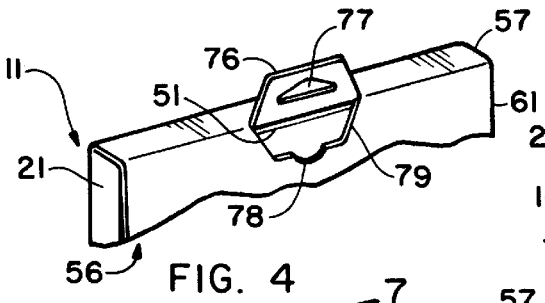
FIG. 4 is a fragmentary view of the top, side and front portions of the carton of FIG. 1.

It will be recognized that the hangtab 76 can be lifted conveniently to a position for hanging the carton 20, said hangtab position being best shown in FIG. 4, by inserting a fingernail (not shown) or a flat tool (not shown) into an arcuate cutout 78, to separate the hangtab 76 from the segment 61, and to raise the hangtab 76 into position.

Figure 7:
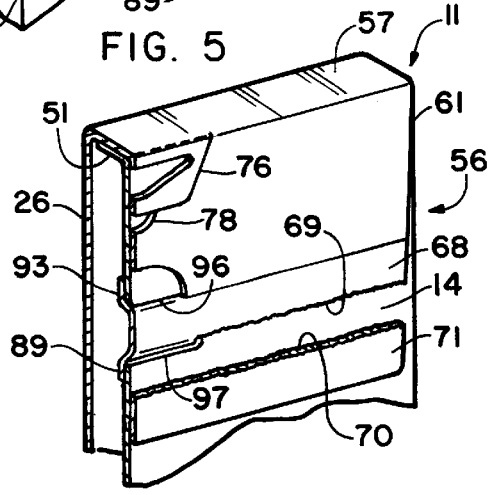
FIG. 7 is a sectional view taken generally along the line 7—7 of FIG. 6.

A relatively common limitation of conventional cartons which include an integrated hangtab is that carton contents can be exposed to damage from dust or debris when the hangtab is lifted into the hanging position, or when it is removed from the carton. The present invention avoids this limitation. As discussed below with respect to carton 20 assembly, and as shown in FIG. 7, the top inside major flap 51 underlies the segment 57 of the top outside major flap 56 to provide continuous closure for the carton 20 contents (see FIGS. 4 and 7). In this novel manner, entry of unwanted substances is prevented and product tamper protection is provided.

FIGS. 1–3, and 5–8 will now be considered with respect to closing, opening and reclosing the carton 20. The process of carton 20 assembly and filling will be more particularly discussed below. Thus, with focus limited at this juncture to the process of closing the carton 20, it can be assumed that the carton has been filled with suitable product. The carton 20 is then closed when the top outside major flap 56 is folded over the top inside major flap 51 and the segment 71 is glued to the front panel 14.

Figure 5:
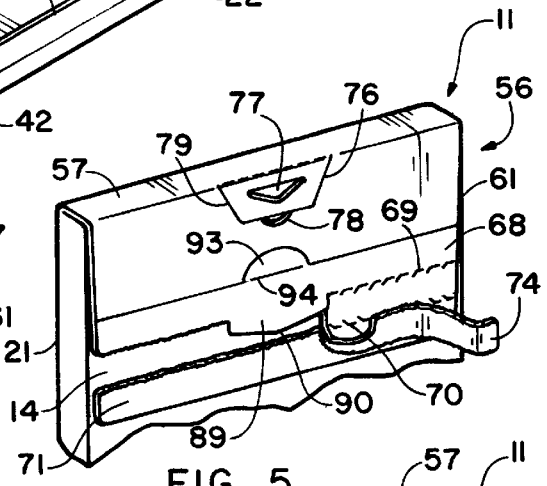
FIG. 5 is a fragmentary view of the top, side and front portions of the carton of FIG. 1, showing a tear strip partially removed.
Figure 6:
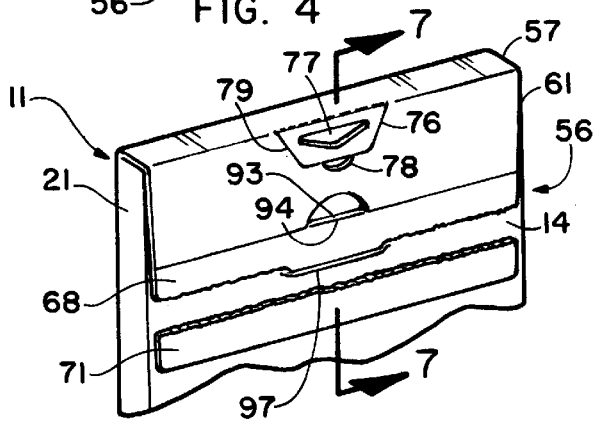
FIG. 6 is a fragmentary view of the top, side and front portions of the carton of FIG. 1, showing the carton in a reclosed condition.
Figure 8:
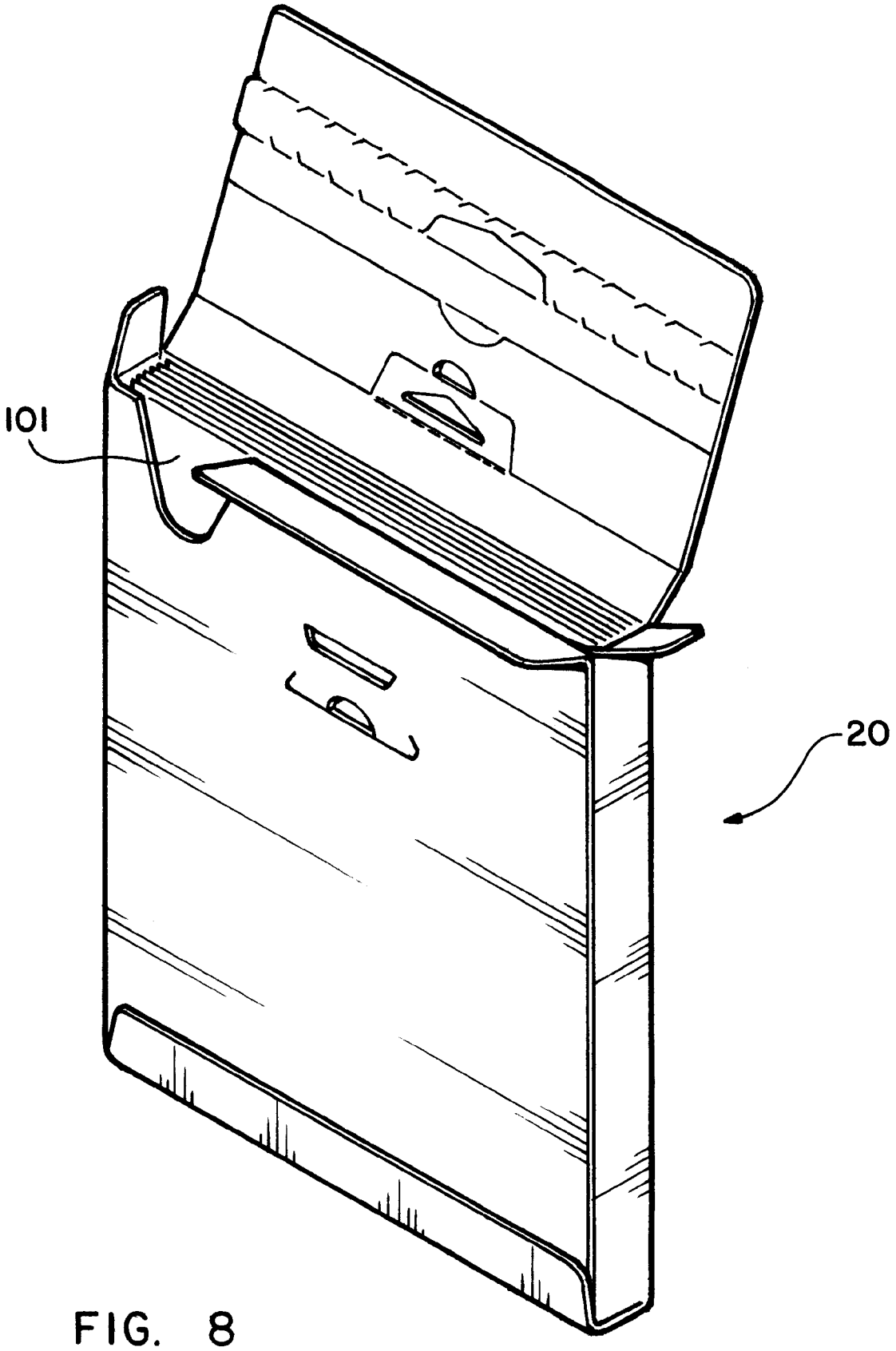
FIG. 8 is a perspective view of the carton of FIG. 1 showing the carton and sheet material contents thereof.

After purchase, in order to open the carton 20 and gain access to its contents, the user simply tears the zipstrip 74 along the cut patterns 69 and 70 (see FIG. 5). Removal of the zipstrip 74 frees the top outside major flap 56 so that it can be moved to an open position, as shown in FIG. 8. Although not shown in FIG. 8 but as illustrated in FIGS. 5 and 6, the segment 71, having been glued thereto, remains attached to the front panel 14 after removal of the zipstrip 74. With the carton 20 opened, the user can conveniently remove a card 101 from the carton 20. Removal is facilitated by a smoothly radiused cutout 99, in the front panel 14, which makes it convenient for the user to remove individual sheet materials, such as the card 101, from the carton 20.

FIGS. 6 and 7 will now be considered with regard to reclosure of the carton 20, after it has been opened and the zipstrip 74 has been torn free. In reclosing the carton 20, reclose tabs 89 and 93 are utilized. The reclose tab 89 projects from, and is foldably connected to, the segment 68 along the cut pattern 69. The tab 89 has a leading edge 90 projecting in a direction away from the segment 68. The reclose tab 93 is in the form of a locking ellipse and it is foldably connected to the segment 68 at a score line 94. As shown in FIGS. 1–3, the locking ellipse 93 is located opposite the reclose tab 89, on the segment 68. The tabs 89 and 93 are each coplanar with the segment 68.

Corresponding to the reclose tab 89 and the locking ellipse 93, on the segment 68, the front panel 14 has corresponding tab receiving means which includes an opening 96 and a slit 97. The opening 96 is generally trapezoidal in configuration, wherein the longer of the two parallel sides is closer to, and parallel to, the score line 53. The slit 97, also located on the front panel 14, is nearer than the opening 96 to the lower end 12 of the carton 20. The slit 97 includes on one of its ends an upturned arcuate lip 103 and, on its other end, a similar upturned arcuate lip 104. An upwardly projecting, centrally located, arcuate cutout 98 in the front panel 14 originates and ends in the slit 97.

To reclose the carton 20, the top outside major flap 56 is folded over the top inside major flap 51, at the upper end 11 of the carton 20. The leading edge 90, followed by the reclose tab 89, is then inserted into the slit 97, as shown in FIG. 6. In this regard, the insertion of the reclose tab 89 is facilitated by the presence of the lips 103 and 104, and the arcuate cutout 98, which cooperate to allow a transient deformation of the front panel 14, thereby easing the insertion of the reclose tab 89. In addition, the presence of a score line 92 permits deflection of the reclose tab 89, thereby further facilitating engagement of the reclose tab 89 with the slit 97.

In a similar manner, after the reclose tab 89 has been inserted, the locking ellipse 93, which can be deflected about the score line 94, is inserted into the trapezoidal opening 96 where it projects upwardly inside the front panel 14. It will be appreciated that, with the oppositely oriented reclose tab 89 and the locking ellipse 93 engaged in their respective receptacles in the front panel 14, the carton 20 is securely reclosed with no openings in the carton for entry of contaminating substances.

Assembly of the carton 20 will now be considered. In this process, the minor bottom flaps 41 and 42 are folded inwardly at their respective score lines 43 and 44, the front panel 14 is folded at the score line 15, and the left side panel 21 is folded at the score line 16 so that the front panel 14 is parallel with the back panel 26. At this time, the glue flap 25 is firmly glued to the inside of the front panel 14. The bottom inside major flap 34 is then folded at the score line 31 to overlap the minor bottom flaps 41 and 42. The bottom outside major flap 35 is then folded along the score line 33 to cover the outside surface of the front panel 14 in such a manner that the bottom glue flap 37 can be glued to the outside surface of the front panel 14.

At this point, the carton 20 can be filled with suitable material, such as the card 101. After it has been filled, the carton 20 is closed when the top outside major flap 56 is folded over the top inside minor flaps 45 and 46 and the top inside major flap 51. The segment 71 is then glued to the front panel 14.

From the foregoing it will be evident that the carton 20 of the present invention provides structural integrity and exposure protection for its contents in a novel manner. In addition, the carton provides a common leveragable design for multiple products, with respect to manufacturing automation, size, features, material source reduction, improved product and package integrity, positive reclosability and easy access.

It will be evident that there are additional embodiments and applications which are not disclosed in the detailed description but which clearly fall within the scope and spirit of the present invention. The specification is, therefore, intended not to be limiting, and the scope of the invention is to be limited only by the following claims.

What is claimed is:

1. A reclosable carton comprising:

a front wall panel, a back wall panel, a pair of opposed side wall panels interconnecting said front and back wall panels, and a bottom wall interconnecting said front, back and side wall panels;

a top inside major flap, said flap being foldably connected to an upper edge of said front wall panel, said flap being folded toward the interior of the carton structure;

a top outside major flap, said flap being foldably connected to an upper edge of said back wall panel, said top outside major flap further including a first segment for overlapping said top inside major flap, said top outside major flap including a second segment foldably connected to said first segment, and a third segment foldably connected to said second segment, said second and third segments overlapping said front wall panel said top outside major flap further including a fourth segment adapted for adhesion to said front panel and a tearstrip, interposed between said third segment and said fourth segment, said tearstrip having a recess for receipt of a tab member;

a first tab member extending from said third segment and foldably connected thereto;

a second tab member extending from said third segment and foldably connected to said third segment, wherein said second tab member extends into said tearstrip recess; and tab member receiving means, disposed in said front wall panel for receipt of said first tab member and of said second tab member for retention therein, whereby said second major top wall flap is releasably held against said front panel to reclose said carton.

2. The reclosable carton according to claim 1, including a top wall having a pair of minor flaps, each one of said pair of minor flaps being foldably connected to an edge of one of said side panels and being folded toward the interior of the carton structure wherein at least one of said pair of minor flaps is overlaid by said top inside major flap.

3. The reclosable carton according to claim 1 wherein said front panel includes an opening for facilitating handling of material for inserting such into said carton or for removing such therefrom.

4. The reclosable carton according to claim 1, wherein said first tab member is elliptical in shape.

5. The reclosable carton according to claim 1, wherein said second tab member includes five sides, two of said sides joining to form a tab member leading edge.

6. The reclosable carton according to claim 1, wherein said tab member receiving means includes a plurality of openings in said front panel.

7. The reclosable carton according to claim 1, wherein said tab receiving means includes a pair of openings in said front panel.

8. The reclosable carton according to claim 7, wherein one of said pair of openings is a slit, said slit having an arcuate lip at each of its ends and further having an elliptical opening formed in said front panel, said elliptical opening originating and ending in said slit wherein said slit, arcuate lips and elliptical opening cooperate to permit temporary deformation of said front panel, thereby facilitating insertion of said tab member into said slit.

9. The reclosable carton according to claim 8, wherein said slit receives said second tab member, for releasable retention thereof.

10. The reclosable carton according to claim 7, wherein one of said pair of openings is trapezoidal in shape.

11. The reclosable carton according to claim 10, wherein said trapezoidal opening receives said first tab member, for releasable retention thereof.

12. An integral, suitably cut and scored blank of sheet material adapted to be erected into a carton, comprising:

first and second major panels;

a pair of opposed side wall panels wherein one of said pair of opposed side wall panels is foldably connected to a side of said second major panel and said second one of said pair of opposed side walls is interposed between, and foldably connected to, said first and second major panels;

a glue flap foldably connected to a side of said one of said pair of opposed side panels;

a first major bottom wall flap foldably connected to said first major panel;

a second major bottom wall flap foldably connected to said second major panel;

a glue flap foldably connected to a side of said second major bottom wall flap;

a pair of minor side panel bottom wall flaps, one of said pair being foldably connected to one of said pair of side panels and another one of said pair being foldably connected to the other one of said pair of side panels;

a top inside major flap foldably connected to said first major panel;

a pair of minor side panel top wall flaps, one of said pair being foldably connected to one of said pair of side panels and the other of said pair being foldably connected to the other one of said pair of side panels;

a top outside major flap foldably connected to said second major panel, said flap including a first segment foldably connected thereto, a second segment foldably connected to said first segment, a third segment foldably connected to said second segment, a tearstrip connected, along a first cut pattern, to said third segment said tearstrip having a tab receiving recess, and a glue flap connected along a second cut pattern to said tearstrip, wherein said second segment includes a trapezoidal hangtab having a base along a perforated line between said hangtab and said first segment, and said third segment includes a pair of oppositely located tab members, the first one of said pair of tab members projecting from said third segment in a direction toward said hangtab, the second one of said pair of tab members projecting away from said third segment in a direction opposite that of said first tab member, said second one of said pair of tab members being received in said tearstrip tab receiving recess;

wherein said first major panel includes a trapezoidal opening for receipt of one of said pair of tab members, and a slit for receipt of another one of said pair of tab members.

13. The blank according to claim 12, wherein said top inside major flap overlaps at least one minor top wall flap when said carton is erected.

14. The blank according to claim 12, wherein one of said tab members is elliptical in shape.

15. The blank according to claim 12, wherein one of said tab members has an angular shape.

16. The blank according to claim 12, wherein said slit includes an arcuate lip at each of its ends and said first major panel has formed therein an arcuate opening, said opening originating and terminating in said slit.

17. The blank according to claim 12, including an opening formed in said first major panel adjacent said first major top wall flap.

* * * * *